United States Patent [19]

Sheridan

[11] 4,233,174

[45] Nov. 11, 1980

[54] QUICK-BREAK CLEANING COMPOSITIONS

[75] Inventor: Geoffrey P. Sheridan, Manchester, England

[73] Assignee: Lankro Chemicals Limited, England

[21] Appl. No.: 3,121

[22] Filed: Jan. 12, 1979

[30] Foreign Application Priority Data

Jan. 19, 1978 [GB] United Kingdom ..... 2160/78
Dec. 15, 1978 [GB] United Kingdom ..... 48773/78

[51] Int. Cl.[3] ..... C11D 1/70; C11D 1/72; C11D 7/50

[52] U.S. Cl. ..... 252/170; 134/40; 252/173; 252/174.21; 252/174.22; 252/557; 252/DIG. 1; 252/DIG. 14

[58] Field of Search ..... 134/40, DIG. 27; 252/174.21, 174.22, 170, 171, 173, 312, 351, DIG. 1, DIG. 14

[56] References Cited

U.S. PATENT DOCUMENTS

| | | | |
|---|---|---|---|
| 3,024,198 | 3/1962 | Harrington et al. | 252/312 |
| 3,282,843 | 11/1966 | Alburger | 252/52 |
| 3,535,160 | 10/1970 | Arger | 134/22 |
| 3,536,529 | 10/1970 | Fiocco | 134/40 |
| 3,553,130 | 1/1971 | Stratton | 252/8.55 |
| 3,577,340 | 5/1971 | Paviak et al. | 210/42 |
| 3,630,953 | 12/1971 | Simon et al. | 252/312 |
| 3,639,255 | 2/1972 | Boardman et al. | 252/312 |
| 3,686,099 | 8/1972 | Gerchenova et al. | 252/554 |
| 3,793,218 | 2/1974 | Canevari | 252/312 |
| 4,098,694 | 7/1978 | Perlaky | 210/59 |

FOREIGN PATENT DOCUMENTS

| | | | |
|---|---|---|---|
| 606198 | 10/1960 | Canada | 252/559 |
| 2529096 | 1/1977 | Fed. Rep. of Germany | 252/89 |
| 51-21414 | 7/1976 | Japan | 252/89 |
| 51-97541 | 8/1976 | Japan | 252/170 |
| 7608911 | 2/1977 | Netherlands | 252/89 |
| 288215 | 2/1971 | U.S.S.R. | 252/559 |

*Primary Examiner*—P. E. Willis, Jr.
*Attorney, Agent, or Firm*—Bacon & Thomas

[57] ABSTRACT

A cleaning composition which comprises: (a) from 35 to 80 wt % of one or both of a fatty alcohol ethoxylate (having from 8 to 18 carbon atoms in the alcohol moiety and from 2 to 10 moles ethylene oxide per mole alcohol) and a higher alkyl phenol ethoxylate (having from 8 to 12 carbon atoms in the alkyl moiety and from 4 to 10 moles ethylene oxide per mole phenol); and (b) from 65 to 20 wt % of a phenol, or lower alkyl phenol, ethoxylate having from 1 to 4 carbon atoms in the alkyl group (if present) and from 3 to 10 moles ethylene oxide per mole phenol.

The composition forms emulsions with oily soils which break quickly on standing. The compositions may therefore be used to emulsify oil sludge in oil storage or transport tanks, the oil being recoverable when the emulsion with the cleaning agent breaks.

13 Claims, No Drawings

QUICK-BREAK CLEANING COMPOSITIONS

FIELD OF THE INVENTION

This invention relates to quick-break cleaning compositions. More particularly, the invention concerns cleaning compositions adapted primarily for use on oily soils and capable with water of forming the soil into a short-lived (thus, quick-break) aqueous emulsion.

BACKGROUND OF THE INVENTION

The road, rail or sea tankers used to transport crude oil normally need to be cleaned after each journey in order to get rid of the oily sludge left as a residue after removal of the main bulk of the contents. In the past tankers have been cleaned with water and a surfactant (or surfactant composition), the resulting emulsion of the sludge in water being thrown away—down the drain into the sewage system, or over the side into the sea, for example. However, such practice is frowned upon today not only because of the possible pollution resulting therefrom but also because quite often the sludge itself is potentially of not insignificant value.

GENERAL DESCRIPTION OF THE INVENTION

The present invention seeks to provide cleaning compositions designed to form with the oily sludge and with water an aqueous emulsion which is unstable, and which if left undisturbed will quickly break—or separate—into an aqueous layer (which can safely be thrown away) and an oil layer (which can be recovered and used).

In one aspect, therefore, this invention provides a cleaning composition which comprises: (a) from 35 to 80 wt % of one or both of a fatty alcohol ethoxylate (having from 8 to 18 carbon atoms in the alcohol moiety and from 2 to 10 moles ethylene oxide per mole alcohol) and a higher alkyl phenol ethoxylate (having from 8 to 12 carbon atoms in the alkyl moiety and from 4 to 10 moles ethylene oxide per mole phenol); and (b) from 65 to 20 wt % of a phenol, or lower alkyl phenol, ethoxylate having from 1 to 4 carbon atoms in the alkyl group (if present) and from 3 to 10 moles ethylene oxide per mole phenol.

DETAILED DESCRIPTION OF THE INVENTION

The fatty alcohol ethoxylate and/or higher alkyl phenol ethoxylate component(s) of the compositions of the invention is the main emulsifying agent employed. It is preferably used in amounts of from 40 to 70 wt % of the composition, especially 50 wt %, in toto.

The alcohol moiety in the fatty alcohol ethoxylate is derived from an alcohol having from 8 to 18 carbon atoms in the chain; particularly useful alcohols are those having 12 to 15 carbon atoms, as well as the commercially-available mixtures of these alcohols.

The ethoxylate moiety in the fatty alcohol ethoxylate may conveniently contain from 2 to 6 ethylene oxide moles per mole; a particularly useful one is the 4 mole/mole moiety.

Naturally, the fatty alcohol ethoxylate may be a mixture of such materials.

The especially preferred fatty alcohol ethoxylates are those such as a 4 mole/mole $C_{12-15}$ ethoxylate mixture. Other suitable fatty alcohol ethoxylates are a 3 mole/mole $C_{9-11}$ ethoxylate mixture, a 3 mole/mole $C_{16-18}$ ethoxylate mixture and a 2 mole/mole $C_{12-15}$ ethoxylate mixture.

The alkyl group of the higher alkyl phenol ethoxylate is one having from 8 to 12 carbon atoms. Preferably it contains 9 carbon atoms.

The ethoxylate moiety of the higher alkyl phenol ethoxylate conveniently contains from 4 to 8 moles ethylene oxide per mole. The preferred ethoxylate moiety contains 6 or 7 moles ethylene oxide per mole.

Naturally, the higher alkyl phenol ethoxylate may be a mixture of such materials.

The particularly preferred higher alkyl phenol ethoxylates are those such as a 6/7 mole/mole $C_9$ ethoxylate mixture.

The phenol, or lower alkyl phenol, ethoxylate component of the compositions of the invention is preferably used in amounts of from 55 to 45 wt % of the composition, especially 50 wt %.

The phenol, or lower alkyl phenol, ethoxylate—which is preferably not lower alkyl substituted—is conveniently one containing from 3 to 6 moles ethylene oxide; a particularly useful ethoxylate is one containing 4 moles/mole.

Naturally, the phenol, or lower alkyl phenol, ethoxylate can be a mixture of such materials.

Compositions of the invention which do not contain any higher alkyl phenol ethoxylate are the preferred compositions.

An especially preferred cleaning composition of the invention is one which contains approximately equal weights of a 4 mole/mole $C_{12-15}$ fatty alcohol ethoxylate and a 4 mole/mole (unsubstituted) phenol ethoxylate.

The compositions of the invention may if desired contain various additives to improve or modify their properties. A typical such additive might be a cloud point elevator such as an alkyl sulphosuccinate like di-isooctyl sulphosuccinate; the use of 10 pbw of this material per 100 pbw of the especially preferred composition mentioned above can elevate the latter's cloud point from 60° C. to 80° C.

The compositions may also be employed as solutions in water or in the common hydrocarbon solvents (Kerosene, white spirit or gas oil, for example), and such solutions will usually contain from 5 to 50 percent by weight of the composition. They may be applied to the soiled surface in all the conventional ways—by dipping, spraying, brushing and so on—and will only allow the formation, with water, of a relatively unstable soil emulsion which, upon undisturbed storage, will rapidly break down to give an aqueous layer and a soil layer; the former can be separated off and thrown away, while the latter can be recovered (and used, if desired).

While the compositions of the invention are of particular value in the cleaning away of the oily sludge found in oil tankers, nevertheless they may also be of use in other applications where there is to be cleaned away an oily soil. Typical such Applications might be in the cleaning and degreasing of metals—for example, of sheet steel—and in the cleaning of internal combustion engines and of motor transport (the latter as in a car wash installation). Furthermore, while in general the compositions are of particular value in the cleaning of oily soils in such a manner that the oil is "easily" recoverable thereafter, they may also find application in any cleaning situation where it is required—or is desirable—that the emulsion and foam formed break quickly to give a non-foamed, non-emulsified mixture or in those applications where enhanced soil penetration is required. With respect to the latter property, products of this invention find particular use in the removal of printing ink from machinery in paper felt washing, and in dewaxing of car bodies.

EXAMPLES

The following Examples and Test Results are now given, though only by way of illustration, to show details of various compositions of the invention.

EXAMPLE 1

50 parts by weight of a $C_{12-15}$ alcohol 4 mole/mole ethoxylate were added to 50 parts by weight of a phenol 4 mole/mole ethoxylate, and the whole blended together with agitation. 10 parts by weight of the resultant mixture (containing 5 parts by weight of each component) were then mixed with 55 parts by weight of BP A 260 (a proprietary aromatic solvent) and 35 parts by weight of RS paraffin (aromatic content 13–17%) to give a clear, bright solution.

The prepared cleaning solution was then used in a simulated Cleaning Test. In this test 10 ml of the solution, 200 ml of water and 40 gms of crude oil (Kuwaiti crude) were vigorously agitated together at 20° C. for 2 minutes, resulting in an emulsion being formed. This emulsion was transferred to a 250 cc measuring cylinder, and the time taken for the emulsion substantially wholely to break (to separate out into oil and water layers) was noted. Each Test was repeated five times, and the results averaged.

The result obtained is shown in the Table below.

EXAMPLES 2–7

In a similar fashion were prepared various blends of different alcohol higher alkyl phenol and phenol ethoxylates (the types, and amounts, are identified in the Table below). These blends were then formulated into cleaning solutions (in an identical manner, using identical materials and amounts), and each cleaning solution was then subjected to an identical simulated Cleaning Test to determine the time the formed emulsion took to break.

The results are also shown in the Table below.

Comparison Solutions A and B

In a similar fashion there were prepared comparison cleaning solutions A and B based upon cleaning compositions A and B not in accordance with the invention. The components of these comparison compositions, and the amounts employed, are identified in the Table below, as are the results obtained from the comparison solutions when subjected to the same Test.

TABLE

| Component | Amount (parts by weight) | | | | | | | Comparisons | |
|---|---|---|---|---|---|---|---|---|---|
| | Ex 1 | Ex 2 | Ex 3 | Ex 4 | Ex 5 | Ex 6 | Ex 7 | A | B |
| $C_{9-11}$ alcohol 3 moles/mole ethoxylate | — | 70 | — | — | — | — | — | — | — |
| $C_{16-18}$ alcohol 3 moles/mole ethoxylate | — | — | 65 | — | — | — | — | — | — |
| $C_{12-15}$ alcohol 2 moles/mole ethoxylate | — | — | — | 80 | 45 | — | — | — | 85 |
| $C_{12-15}$ alcohol 4 moles/mole ethoxylate | 50 | — | — | — | — | 30 | — | 90 | — |
| $C_9$-alkyl phenol 6.5 moles/mole ethoxylate | — | — | — | — | — | 20 | 40 | — | — |
| Phenol 4 mole/mole ethoxylate | 50 | 30 | 35 | — | 45 | 50 | 60 | 10 | — |
| Phenol 10 mole/mole ethoxylate | — | — | — | 20 | — | — | — | — | 15 |
| Di-isooctyl sulphosuccinate | — | — | — | — | 10 | — | — | — | — |
| Time to break (hrs) | 2.6 | 3.7 | 4.2 | 3.2 | 2.8 | 6.2 | 7.8 | >18 | >18 |

Naturally the invention includes a method of cleaning oily soil from a substrate which comprises applying a composition of the invention, optionally as a solution, to emulsify the soil and optionally allowing the emulsion to break and recovering the oily material.

Also the invention includes materials thus recovered.

We claim:

1. A cleaning composition which comprises:

(a) from 35 to 80 wt % of a surfactant selected from the group consisting of a fatty alcohol ethoxylate having from 8 to 18 carbon atoms in the alcohol moiety and from 2 to 10 moles ethylene oxide per mole alcohol, a higher alkyl phenol ethoxylate having from 8 to 12 carbon atoms in the alkyl moiety and from 4 to 10 moles ethylene oxide per mole phenol and mixtures thereof; and (b) from 65 to 20 wt % of phenol ethoxylate having from 3 to 10 moles ethylene oxide per mole of phenol.

2. A cleaning composition as claimed in claim 1 containing from 40 to 70 wt % of the said surfactant.

3. A cleaning composition as claimed in claim 1 wherein said surfactant is a fatty alcohol ethoxylate derived from an alcohol having 12 to 15 carbon atoms.

4. A cleaning composition as claimed in claim 1 wherein said surfactant is a fatty alcohol ethoxylate formed by ethoxylating a fatty alcohol with from 2 to 6 moles of ethylene oxide per mole.

5. A cleaning composition as claimed in claim 1 wherein said surfactant is a higher alkyl phenol ethoxylate containing 9 carbon atoms in the alkyl moiety.

6. A cleaning composition as claimed in claim 1 wherein said surfactant is a higher alkyl phenol ethoxylate containing the residues of from 4 to 8 moles of ethylene oxide per mole.

7. A cleaning composition as claimed in claim 1 containing an alkyl sulphosuccinate cloud point elevator.

8. A composition as claimed in claim 1 dissolved in a solvent selected from the group consisting of water and a hydrocarbon.

9. A composition as claimed in claim 8 containing from 95 to 50 percent by weight of the solvent.

10. A method of removing an oily soil from a substrate which comprises applying a composition as claimed in claim 1 to the soil whereby the oily soil is emulsified and removed.

11. A method as claimed in claim 10 wherein the emulsion is allowed to stand until it breaks, and the oily and composition phases are separated.

12. A composition as claimed in claim 1 which is a solution in a solvent selected from the group consisting of white spirit, kerosene and gas-oil of about equal parts by weight of a $C_{12}$ to $C_{15}$ fatty alcohol ethoxylate containing about 4 moles of ethylene oxide per mole and about 50% by weight of phenol ethoxylate containing about 4 moles of ethylene oxide per mole.

13. A method of cleaning an oil storage tank which comprises cleaning the tank with a composition as claimed in claim 12 to form an oil emulsion removing the emulsion from the tank and allowing the emulsion to stand until it breaks, and recovering the oil from the broken emulsion.

* * * * *